US009875704B2

(12) United States Patent
Sung et al.

(10) Patent No.: US 9,875,704 B2
(45) Date of Patent: Jan. 23, 2018

(54) LIQUID CRYSTAL DISPLAY PANEL AND PIXEL CELL CIRCUIT SOLVING COLOR SHIFT PROBLEM

(71) Applicant: InnoLux Corporation, Miao-Li County (TW)

(72) Inventors: Li-Wei Sung, Miao-Li County (TW); Chung-Yi Wang, Miao-Li County (TW); Yao-Lien Hsieh, Miao-Li County (TW); Wei-Jung Chiu, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 218 days.

(21) Appl. No.: 14/656,474

(22) Filed: Mar. 12, 2015

(65) Prior Publication Data

US 2015/0261026 A1 Sep. 17, 2015

(30) Foreign Application Priority Data

Mar. 14, 2014 (TW) ..... 103109367 A

(51) Int. Cl.
*G09G 3/36* (2006.01)

(52) U.S. Cl.
CPC ... *G09G 3/3648* (2013.01); *G09G 2300/0447* (2013.01); *G09G 2300/0465* (2013.01);
(Continued)

(58) Field of Classification Search
CPC .... G09G 3/3648; G09G 3/3659; G09G 3/003; G09G 3/3674; G02F 1/13624
See application file for complete search history.

(56) References Cited

U.S. PATENT DOCUMENTS

| | | | | |
|---|---|---|---|---|
| 9,430,975 | B2 | 8/2016 | Yao et al. | |
| 2009/0091670 | A1* | 4/2009 | Tsai | G09G 3/3648 349/38 |
| 2011/0205461 | A1* | 8/2011 | Chen | G09G 3/3648 349/38 |

FOREIGN PATENT DOCUMENTS

| | | |
|---|---|---|
| CN | 103353697 A | 10/2013 |
| TW | 201039033 | 11/2010 |

OTHER PUBLICATIONS

Chinese language office action dated Nov. 16, 2015, issued in application No. TW 103109367.

(Continued)

*Primary Examiner* — Chanh Nguyen
*Assistant Examiner* — Sepehr Azari
(74) *Attorney, Agent, or Firm* — McClure, Qualey & Rodack, LLP

(57) ABSTRACT

A liquid crystal display panel includes multiple pixel units each connected to a data line and a gate line. The pixel unit defines a first region and a second region. A first liquid crystal capacitor is disposed in the first region. A first transistor is disposed in the first region and is connected between the data line and the first liquid crystal capacitor, and has a control electrode connected to the gate line. A second liquid crystal capacitor is disposed in the second region. A second transistor is disposed in the second region and is connected between the data line and the second liquid crystal capacitor, and has a control electrode connected to the gate line. A third transistor is disposed in the second region and is connected between a common voltage and the second transistor and has a control electrode connected to the gate line.

6 Claims, 10 Drawing Sheets

(52) U.S. Cl.
CPC ..... *G09G 2300/0876* (2013.01); *G09G 2320/0242* (2013.01)

(56) References Cited

OTHER PUBLICATIONS

Chinese language office action dated Aug. 1, 2017, issued in application No. CN 201410096536.8.

* cited by examiner

LIQUID CRYSTAL DISPLAY PANEL AND PIXEL CELL CIRCUIT SOLVING COLOR SHIFT PROBLEM

CROSS REFERENCE TO RELATED APPLICATIONS

This application claims priority of Taiwan Patent Application No. 103109367, filed on Mar. 14, 2014, the entirety of which is incorporated by reference herein.

BACKGROUND OF THE INVENTION

Field of the Invention

The invention relates to a pixel unit circuit, and more particularly to a pixel unit circuit to solve the color shift problem associated with the wide view angle LCD panel.

Description of the Related Art

The LCD panel is an increasingly popular display panel that has a high resolution, light weight, thin and has low power consumption. However, current LCD panels still have some technological problems that need to be solved. For example, a problem associated with a wide view angle still exists, in which the user sees the displayed image with the different gray-scale levels and brightness when he or she is watching the image from the front or at an angle from the either right or left side of the display. Usually, the brightness of the image as seen by the user from the front of the display is higher than that when it is seen from either side of the display. Therefore, the frames viewed on the LCD apparatus at different angles have different brightness, which causes different color mixing results. Thus, the phenomena of color shift and color de-saturation tend to occur.

Recently, a new pixel structure has been proposed to solve the color shift problem associated with the wide view angle LCD panel. For the prior art technology, reference can be made to China patent application number 200810005696.1. However, in the prior art, each pixel has to be electronically connected to at least two gate lines, and it functions according to the corresponding gate driving signals on these two gate lines. In such a method, not only is the aperture ratio of the pixel circuit occupied, but also the number of channels of gate driving signals increases, causing the timing control to become complicated.

Therefore, a novel pixel structure to solve the color shift problem associated with the wide view angle LCD panel and further solve the problems in the prior art's is required.

BRIEF SUMMARY OF THE INVENTION

A liquid crystal display panel and pixel unit circuit are provided. An exemplary embodiment of a liquid crystal display panel comprises a plurality of pixel units. Each of the pixel units is connected to a data line and a gate line and defines a first region and a second region. The pixel unit comprises a first liquid crystal capacitor, a first transistor, a second liquid crystal capacitor, a second transistor and a third transistor. The first liquid crystal capacitor is disposed in the first region. The first transistor is disposed in the first region and connected between the data line and the first liquid crystal capacitor, and comprises a control electrode connected to the gate line. The second liquid crystal capacitor is disposed in the second region. The second transistor is disposed in the second region and connected between the data line and the second liquid crystal capacitor, and comprises a control electrode connected to the gate line. The third transistor is disposed in the second region and connected between a common voltage and the second transistor and comprises a control electrode connected to the gate line.

An exemplary embodiment of a pixel unit circuit comprises a first liquid crystal capacitor, a first transistor, a second liquid crystal capacitor, a second transistor and a third transistor. The first transistor is connected between a data line and the first liquid crystal capacitor and comprises a control electrode connected to a gate line. The second transistor is connected between the data line and the second liquid crystal capacitor and comprises a control electrode connected to the gate line. The third transistor is connected between a common voltage and the second transistor and comprises a control electrode connected to the gate line.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein:

FIG. 4 shows an equivalent circuit diagram of the pixel unit shown in FIG. 3 when the pixel unit is turned on;

FIG. 7 shows an equivalent circuit diagram of the pixel unit shown in FIG. 6 when the pixel unit is turned on;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
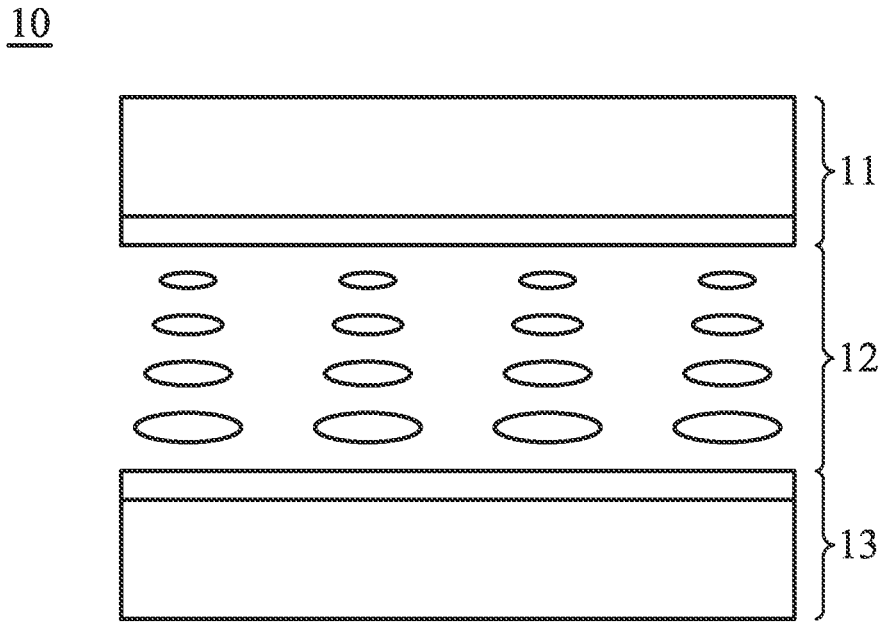
FIG. 1 shows a cross-sectional view of a liquid crystal display panel according to an embodiment of the invention.

FIG. 1 shows a cross-section view of a liquid crystal display (LCD) panel according to an embodiment of the invention. As shown in FIG. 1, the LCD panel 10 may comprises a color filter substrate 11, a thin-film transistor substrate 13, and a liquid crystal layer 12 disposed between the color filter substrate 11 and the thin-film transistor substrate 13. The liquid crystal layer 12 may comprise a plurality of liquid crystal molecules. The pixel electrode is formed on the thin-film transistor substrate 13, where the thin-film transistor substrate is also called an array substrate.

Figure 2:
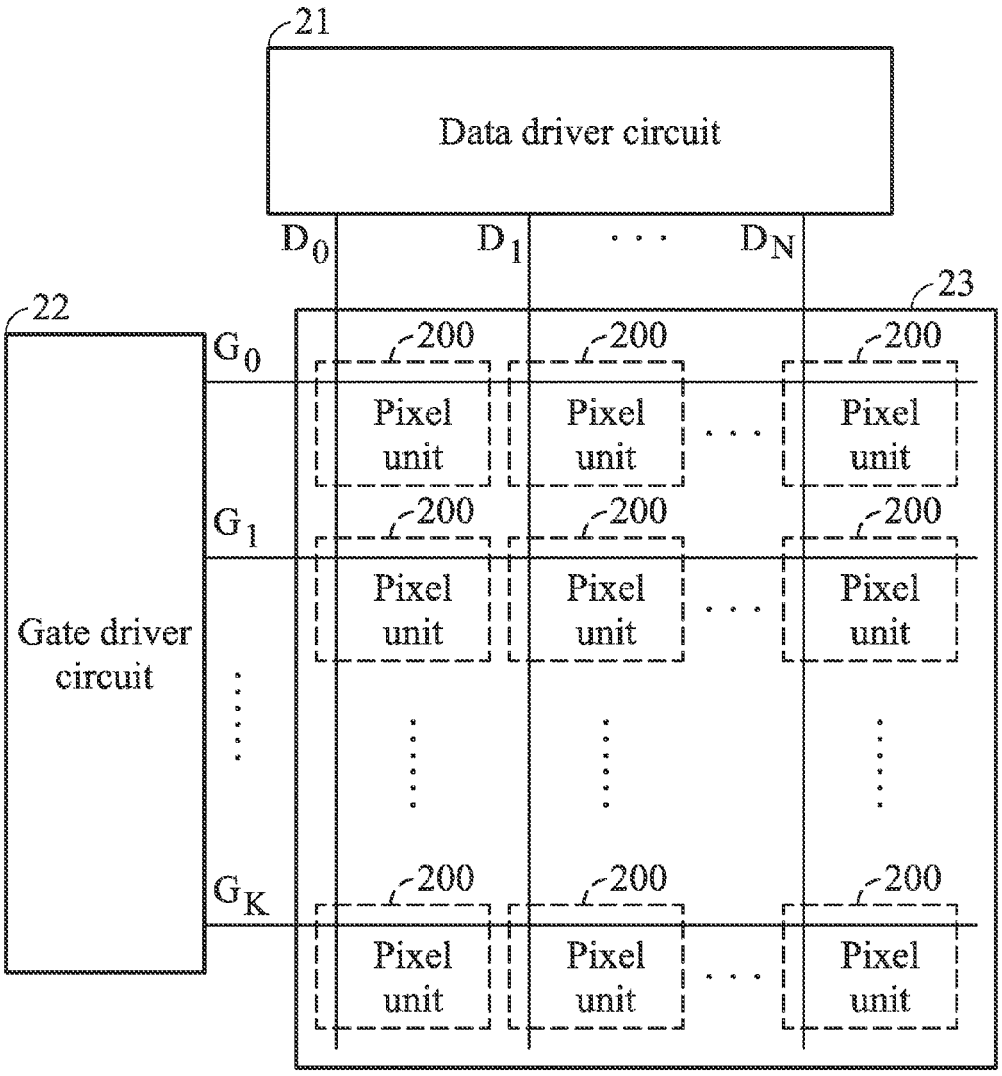
FIG. 2 shows a block diagram of a liquid crystal display panel circuit according to an embodiment of the invention.

FIG. 2 shows a block diagram of a LCD panel circuit according to an embodiment of the invention. The data driver circuit 21 is connected to a plurality of data lines $D_0$~$D_N$ of the pixel array 23, for providing a plurality of data driving signals to the pixel array 23. The gate driver circuit 22 comprises a plurality of gate lines $G_0$~$G_K$ connected to the pixel array 23, for providing a plurality of gate driving signals to the pixel array 23. The pixel array 23 may comprise a plurality of pixel units 200. Each pixel unit 200 is connected to cross-coupled gate line and data line. The data driver circuit 21, gate driver circuit 22 and pixel array 23 are formed on the thin-film transistor substrate 13 shown in FIG. 1.

Figure 3:
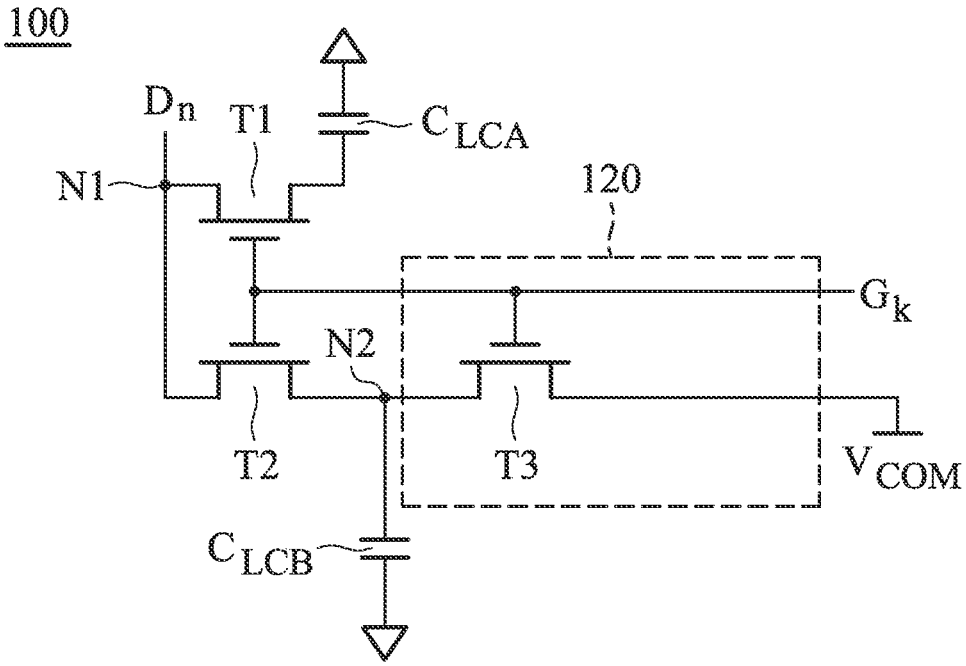
FIG. 3 shows a circuit diagram of a pixel unit according to an embodiment of the invention.

FIG. 3 shows a circuit diagram of a pixel unit according to an embodiment of the invention. According to an embodiment of the invention, the pixel unit 100 shown in FIG. 3 may be one of the plurality of pixel units of the LCD panel. In addition, in the embodiment of the invention, the pixel unit may correspond to a single pixel for a monochromatic display or a single sub-pixel for a color display. The sub-pixel can be red (represented by "R") color sub-pixel, blue (represented by "B") color sub-pixel, or green (represented by "G") color sub-pixel. A single pixel is formed by a combination of RGB color sub-pixels (corresponding to the pixel unit in the embodiments of the invention).

According to an embodiment of the invention, the pixel unit 100 is connected to the $n^{th}$ data line $D_n$ and the $k^{th}$ gate line $G_k$, where n is a positive integer smaller than or equal to the positive integer N, and k is a positive integer smaller than or equal to the positive integer K. The pixel unit 100 comprises liquid crystal capacitors $C_{LCA}$ and $C_{LCB}$, and transistors T1, T2 and T3. According to an embodiment of the invention, to improve the color shift problem associated with the wide view angle LCD panel, the pixel electrode of each pixel unit 100 may be separated into a first region and a second region. The first region of the pixel unit 100 comprises the liquid crystal capacitor $C_{LCA}$, and the second region of the pixel unit 100 comprises the liquid crystal capacitor $C_{LCB}$. The liquid crystal capacitor $C_{LCA}$ is defined by a first pixel electrode in the first region and a common electrode of the corresponding pixel unit 100, and the liquid crystal capacitor $C_{LCB}$ is defined by a second pixel electrode in the second region and the common electrode of the corresponding pixel unit 100.

The transistor T1 is connected between the data line $D_n$ and the liquid crystal capacitor $C_{LCA}$, and comprises a control electrode connected to the gate line $G_k$. The transistor T2 is connected between the data line $D_n$ and the liquid crystal capacitor $C_{LCB}$, and comprises a control electrode connected to the gate line $G_k$. The transistor T3 is connected between the common voltage $V_{COM}$ and the transistor T2, and comprises a control electrode connected to the gate line $G_k$. The liquid crystal capacitor $C_{LCB}$ is connected to a connection node N2 of the transistors T2 and T3.

Figure 4:
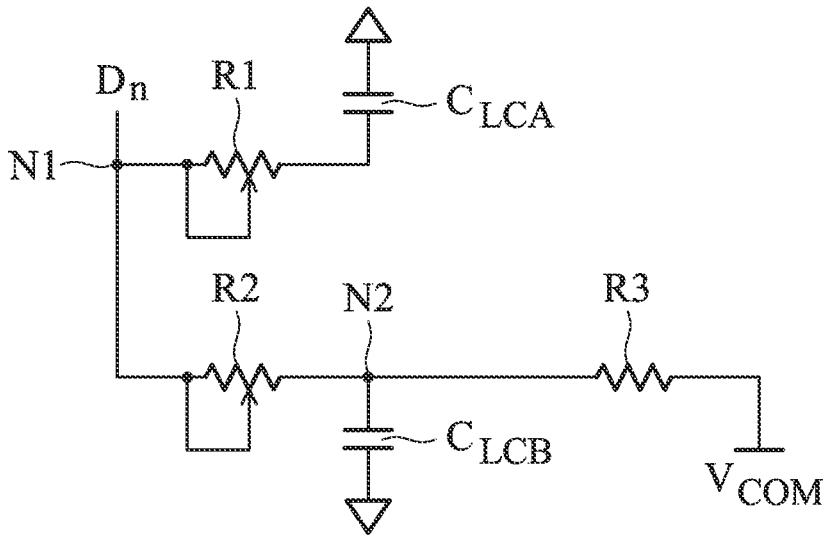

FIG. 4 shows an equivalent circuit diagram of the pixel unit shown in FIG. 3 when the pixel unit is turned on. When the transistors T1, T2 and T3 are turned on in response to the gate driving signal on the gate line $G_k$, the pixel unit 100 is turned on. The resistor R1 represents the equivalent resistor when the transistor T1 is turned on, the resistor R2 represents the equivalent resistor when the transistor T2 is turned on, and the resistor R3 represents the equivalent resistor when the transistor T3 is turned on. According to an embodiment of the invention, the transistor T3 is arranged to provide a divided voltage at the node N2 according to the voltage of the data signal provided on the data line $D_n$, such that the voltage VB at the node N2 is different from the voltage VA at the node N1. In this manner, different voltages are applied to the liquid crystal capacitors $C_{LCA}$ and $C_{LCB}$, so as to solve the color shift problem associated with the wide view angle LCD panel. In an embodiment of the invention, the transistor T3 may act as a Low Color Shift Resistor (LCSR) 120.

As shown in FIG. 4, since the voltage applied to the data line $D_n$ is variable, the turned-on resistance of the transistors T1 and T2 are also variable. Therefore, the equivalent resistors R1 and R2 are analogous to variable resistors when the transistors T1 and T2 are turned on. On the other hand, since the common voltage $V_{COM}$ is a fixed voltage, the equivalent resistor R3 when the transistor T3 is turned on is not analogous to a variable resistor. Since the resistors R1 and R2 are analogous to variable resistors but the resistor R3 is not analogous to a variable resistor, the voltages at the nodes N1 and N2 cannot be kept in a fixed ratio, and the color shift problem is not improved very well.

Figure 5:
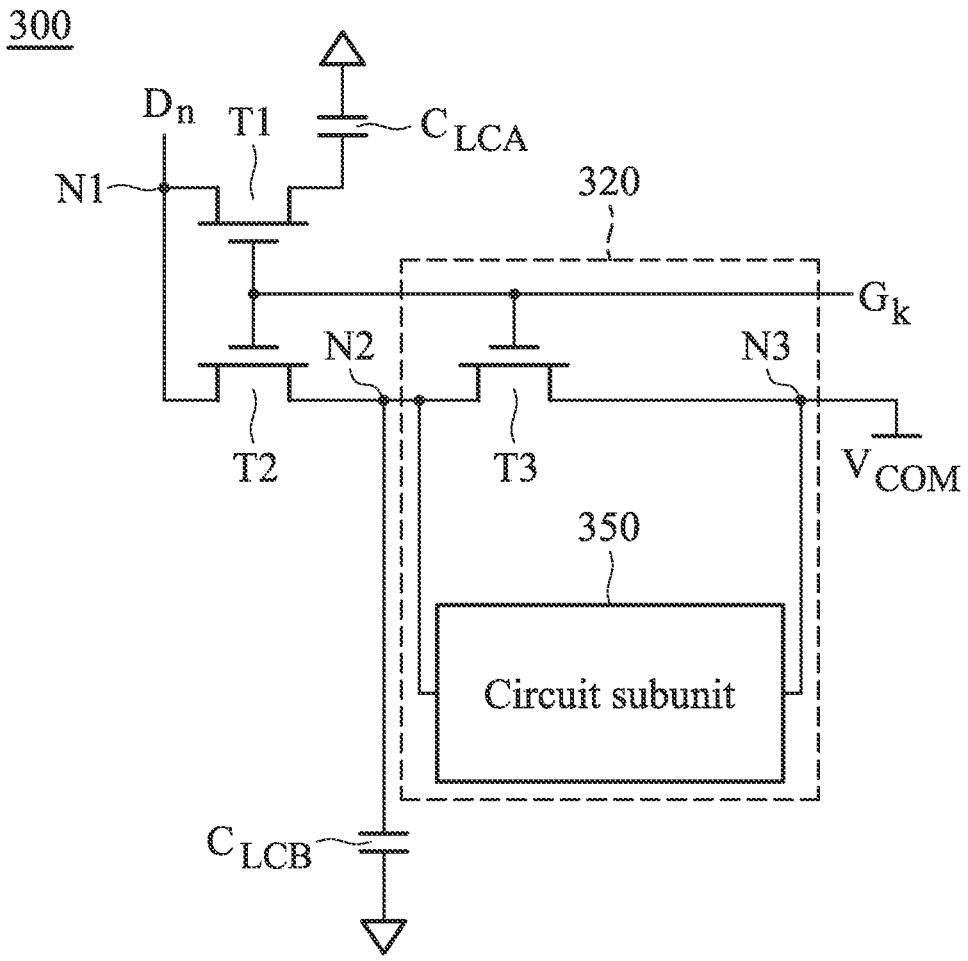
FIG. 5 shows another circuit diagram of a pixel unit according to another embodiment of the invention.

FIG. 5 shows another circuit diagram of a pixel unit according to another embodiment of the invention. The pixel unit 300 is connected to the $n^{th}$ data line $D_n$ and the $k^{th}$ gate line $G_k$, where n is a positive integer smaller than or equal to the positive integer N and k is a positive integer smaller than or equal to the positive integer K. The pixel unit 300 comprises liquid crystal capacitors $C_{LCA}$ and $C_{LCB}$, and transistors T1, T2 and T3. The structure of the pixel unit 300 is substantially similar to that of the pixel unit 100. Therefore, the illustrations of the same elements may refer to the illustrations of FIG. 3, and are omitted here for brevity. In an embodiment of the invention, in order to further improve the color shift problem, the pixel unit 300 may further comprise a circuit subunit 350. The circuit subunit 350 and the transistor T3 are connected in parallel between the common voltage $V_{COM}$ and the transistor T2. That is, the circuit subunit 350 and the transistor T3 are connected in parallel between the nodes N2 and N3 to act as an LCSR 320 of the pixel unit 300.

According to an embodiment of the invention, the circuit subunit 350 provides another voltage division path. When the transistors T1~T3 are turned on in response to the gate driving signal on the gate line $G_k$, an equivalent resistor of the circuit subunit 350 and the transistor T3 coupled in parallel forms an LCSR 320 between the common voltage $V_{COM}$ and the transistor T2. The LCSR 320 is analogous to a variable resistor. The LCSR 320 may keep a ratio of the voltages at the nodes N1 and N2 to a substantially fixed value, such that the color shift problem can be greatly improved as compared to the embodiment shown in FIG. 3-FIG. 4.

Figure 6:
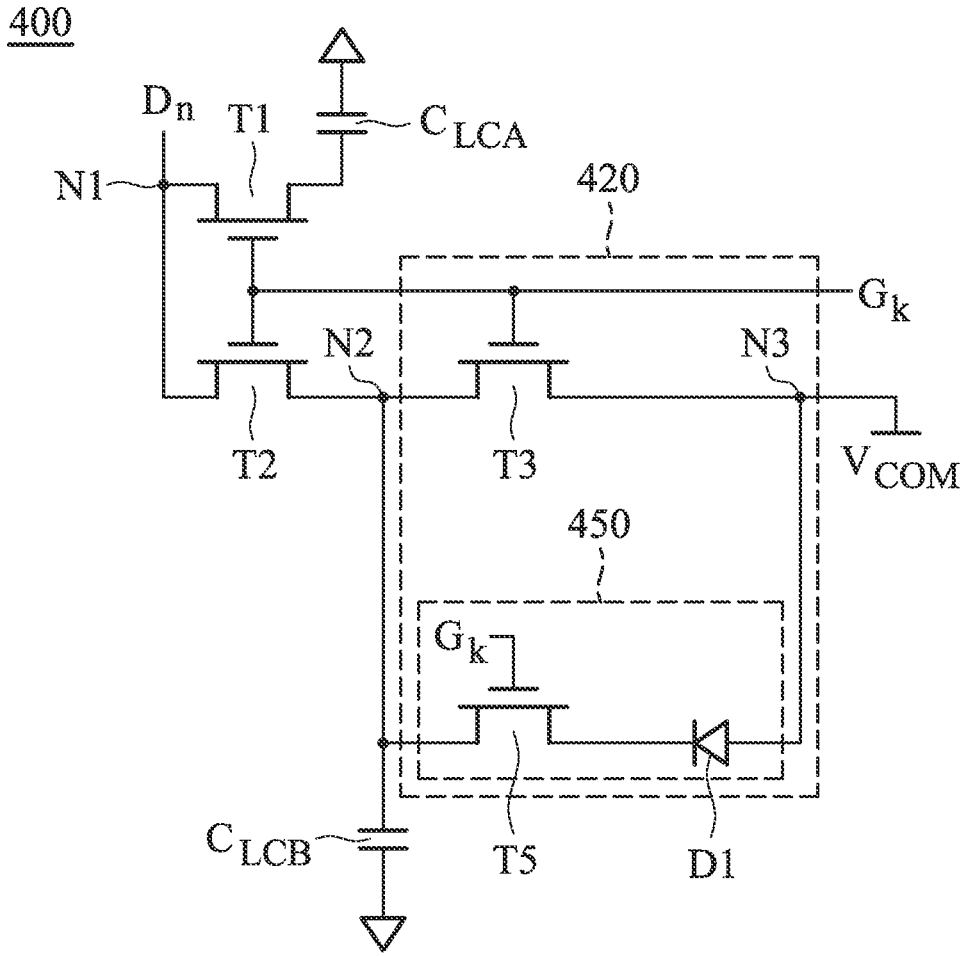
FIG. 6 shows another circuit diagram of a pixel unit according to yet another embodiment of the invention.

FIG. 6 shows another circuit diagram of a pixel unit according to yet another embodiment of the invention. The pixel unit 400 is connected to the $n^{th}$ data line $D_n$ and the $k^{th}$ gate line $G_k$, where n is a positive integer smaller than or equal to the positive integer N and k is a positive integer smaller than or equal to the positive integer K. The pixel unit 400 comprises liquid crystal capacitors $C_{LCA}$ and $C_{LCB}$, and transistors T1, T2 and T3. The structure of the pixel unit 400 is substantially similar to that of the pixel unit 100. Therefore, the illustrations of the same elements may be referred to in the illustrations of FIG. 3, and are omitted here for brevity. In an embodiment of the invention, the circuit subunit 450 coupled in parallel with the transistor T3 between the common voltage $V_{COM}$ and the transistor T2 comprises the transistor T5 and the diode D1. An anode of the diode D1 is connected to the common voltage $V_{COM}$. The transistor T5 is connected between a cathode of the diode D1 and the transistor T2. That is, the transistor T5 is connected between the cathode of the diode D1 and the node N2. The transistor T5 comprises a control electrode connected to the gate line $G_k$. In the embodiment of the invention, the transistor T5 and the diode D1 and the paralleling connected transistor T3 may together act as an LCSR 420 of the pixel unit 400.

Figure 7:
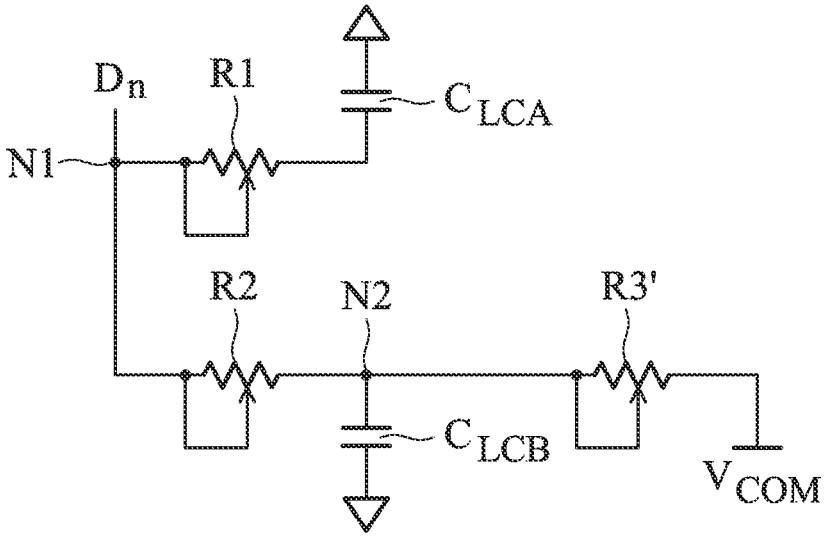

FIG. 7 shows an equivalent circuit diagram of the pixel unit shown in FIG. 6 when the pixel unit is turned on. When the transistors T1, T2 and T3 are turned on in response to the gate driving signal on the gate line $G_k$, the pixel unit 400 is turned on. The resistor R1 represents the equivalent resistor when the transistor T1 is turned on, the resistor R2 represents the equivalent resistor when the transistor T2 is turned on, and the resistor R3' represents the equivalent resistor when the transistor T3, the transistor T5 and the diode D1 are turned on. That is, the resistor R3' represents the LCSR 420. According to an embodiment of the invention, by connecting the transistor T5 and the diode D1 and the transistor T3 in parallel between the common voltage $V_{COM}$ and the transistor T2, the equivalent resistor R3', which is analogous to a variable resistor, is formed. In this manner, a ratio of the voltages at the nodes N1 and N2 is kept to a substantially fixed value. Operations of the pixel unit shown in FIG. 6 and FIG. 7 are further illustrated in the following paragraphs.

According to an embodiment of the invention, the diode D1 is turned on during the negative half-cycle of the LCD panel, where in the positive half-cycle of the LCD panel, the voltage of the data driving signal $D_n$ is greater than the common voltage $V_{COM}$, and in the negative half-cycle of the LCD panel, the voltage of the data driving signal $D_n$ is smaller than the common voltage $V_{COM}$. Therefore, when the voltage of the data driving signal $D_n$ is smaller than the common voltage $V_{COM}$, a voltage at the anode of the diode D1 is greater than a voltage at the cathode of the diode D1, so the diode D1 is turned on. Meanwhile, when the transistor T5 is turned on in response to the gate driving signal on the gate line $G_k$, the circuit subunit 450 is turned on to form an equivalent resistor connected in parallel with the equivalent resistor of the transistor T3. Thereby, the resistance of the overall equivalent resistor (that is, the equivalent resistance of the LCSR 420) can be reduced. Since the turn-on resistance of the transistor T2 in the negative half-cycle is smaller than that in the positive half-cycle, and in the negative half-cycle, the equivalent resistance of the LCSR 420 can also be reduced due to the turned-on circuit subunit 450, thereby, a ratio of the voltages at the nodes N1 and N2 is kept to a substantially fixed value.

Note that those who are skilled in this technology can make various alterations and modifications based on the concept illustrated above to design the circuit subunit 350, such that the equivalent resistance of the LCSR 320 is increased during the positive half-cycle, or making the equivalent resistance of the LCSR 320 adjustable and able to vary with the change in the turn-on resistance of the transistor T2 during the positive half-cycle and the negative half-cycle. In this manner, a similar result of keeping the ratio of the voltages at the nodes N1 and N2 to a substantially fixed value can be achieved.

Figure 8:
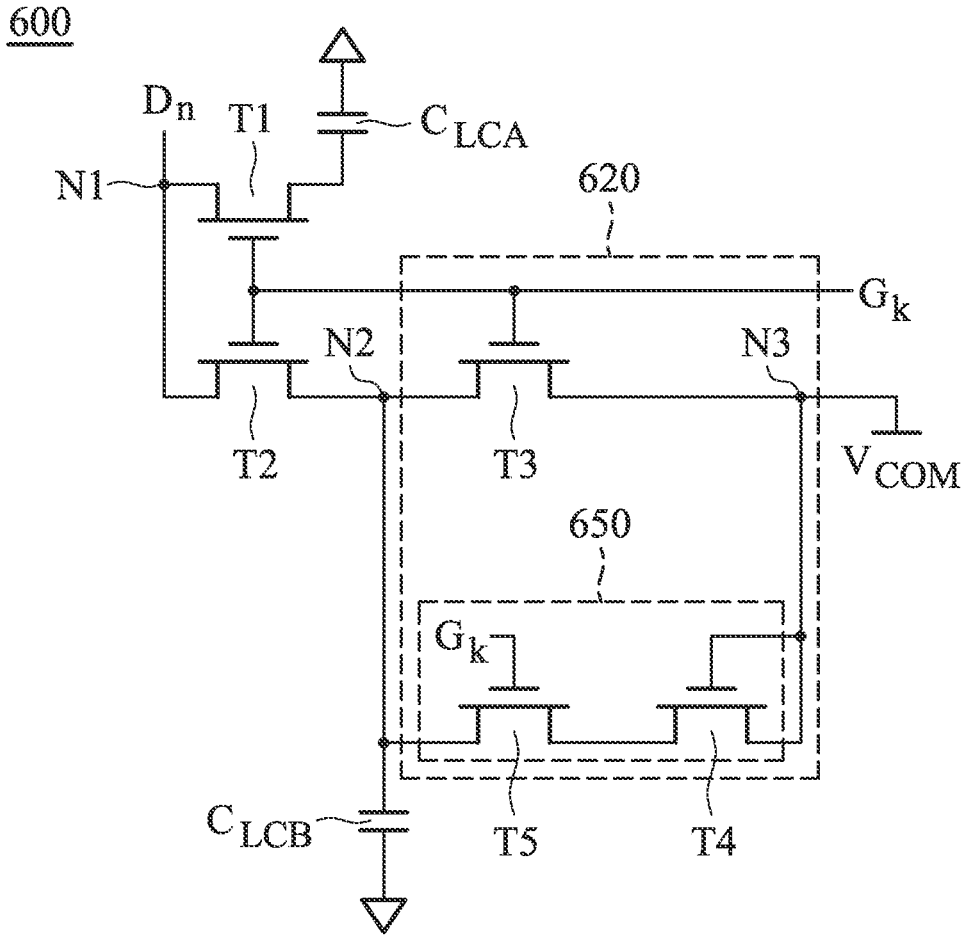
FIG. 8 shows yet another circuit diagram of a pixel unit according to yet another embodiment of the invention.

FIG. 8 shows yet another circuit diagram of a pixel unit according to yet another embodiment of the invention. The pixel unit 600 is connected to the $n^{th}$ data line $D_n$ and the $k^{th}$ gate line $G_k$, where n is a positive integer smaller than or equal to the positive integer N and k is a positive integer smaller than or equal to the positive integer K. The pixel unit 600 comprises liquid crystal capacitors $C_{LCA}$ and $C_{LCB}$, and transistors T1, T2 and T3. The structure of the pixel unit 600 is substantially similar to that of the pixel unit 100. Therefore, the illustrations of the same elements may refer to the illustrations of FIG. 3, and are omitted here for brevity. In an embodiment of the invention, the circuit subunit 650 connected in parallel with the transistor T3 between the common voltage $V_{COM}$ and the transistor T2 comprises transistors T4 and T5. The transistor T4 comprises a control electrode connected to the common voltage $V_{COM}$. The transistor T5 is connected between the transistors T4 and T2 and comprises a control electrode connected to the gate line $G_k$. In the embodiment of the invention, the transistors T4 and T5 and the parallel connected transistor T3 may together act as an LCSR 620 of the pixel unit 600.

The equivalent circuit diagram of the pixel unit 600 when the pixel unit 600 is turned on may be referred to in FIG. 7. Since the operations of the pixel unit 600 are similar to that of the pixel unit 400, regarding the illustrations of the operations of the pixel unit 600, reference may be made to the illustrations of FIG. 6 and FIG. 7, and are omitted here for brevity.

Figure 9:
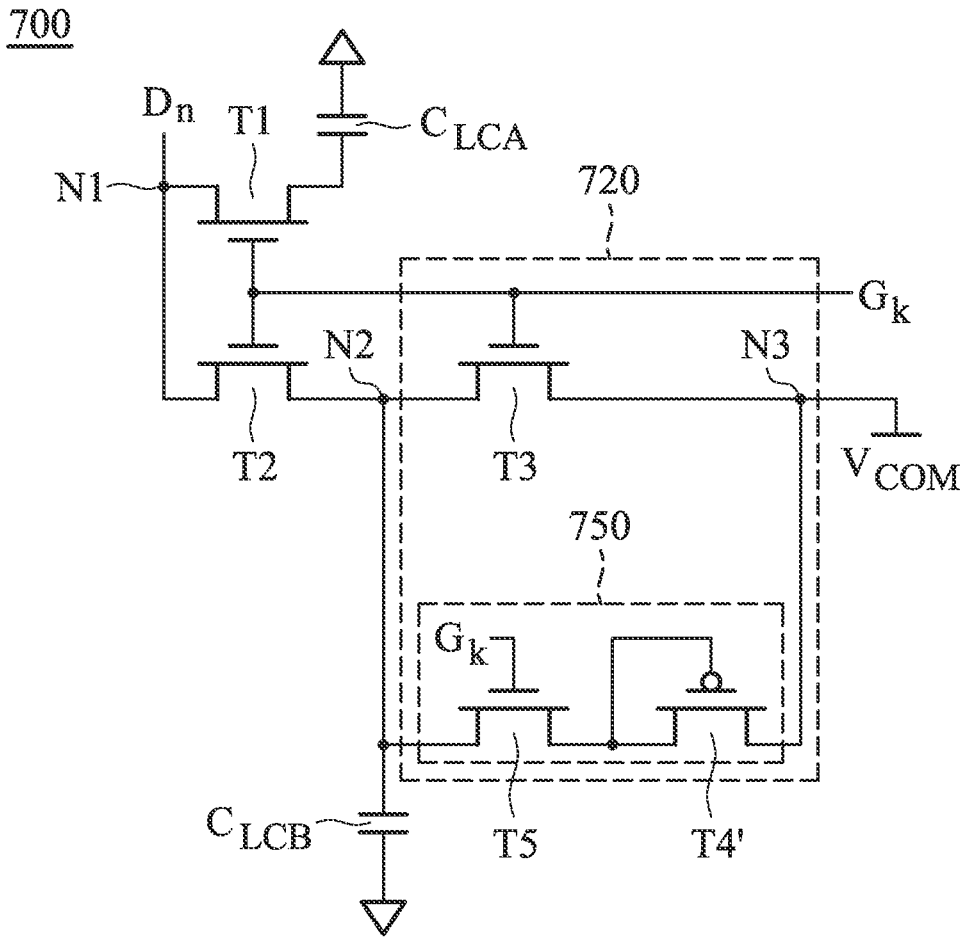
FIG. 9 shows still another circuit diagram of a pixel unit according to still another embodiment of the invention.

FIG. 9 shows still another circuit diagram of a pixel unit according to still another embodiment of the invention. The circuit diagram of the pixel unit 700 is similar to that of the pixel unit 600. The differences are in that the type of the transistor T4' is different from that of the transistors T1~T3 and T5, and the control electrode of the transistor T4' is connected to an electrode of the transistors T5 and T4'. Note the connections of the elements in the embodiments as discussed above can be either be made by coupling or direct electrical connection.

Figure 10:
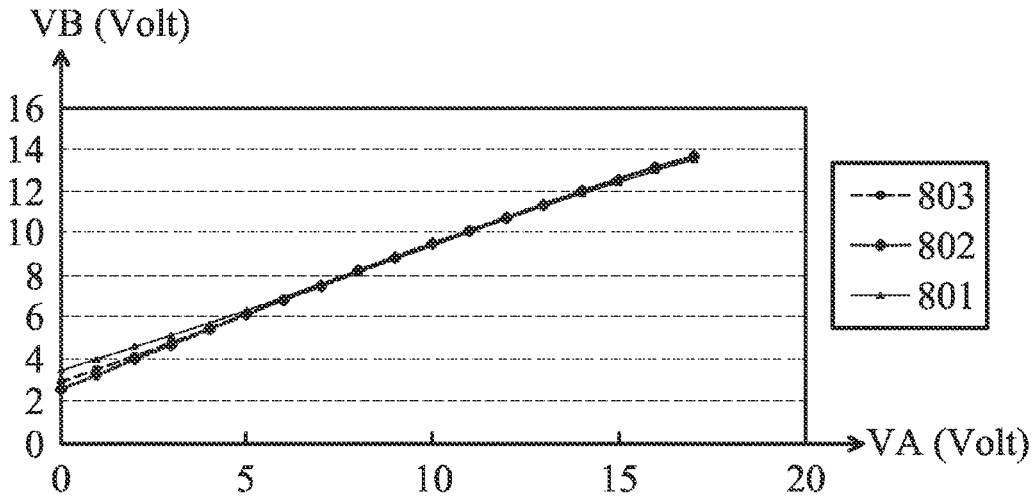
FIG. 10 is a diagram showing the relationship of the voltages VA and VB at the nodes N1 and N2 according to an embodiment of the invention.

FIG. 10 is a diagram showing the relationship of the voltages VA and VB at the nodes N1 and N2 according to an embodiment of the invention, where the voltage VA at the node N1 is the voltage of the data driving signal. In the embodiment of the invention, the common voltage is set to 8.5 volt. The curve 801 represents the ideal voltage curve, the curve 802 represents the voltage curve obtained by implementing the pixel unit circuit as shown in FIG. 4, and the curve 803 represents the voltage curve obtained by implementing the pixel unit circuit as shown in FIG. 6. As shown in FIG. 10, during the negative half-cycle (that is when the voltage at the node N1 is smaller than 8.5 volt), the curve 803 tends to be closer to the curve 801 than the curve 802. Therefore, the color shift problem is effectively solved when introducing the circuit subunit.

In the embodiment of the invention, the width to length ratio W/L of each transistor can be specially designed such that a better solution to the color shift problem can be achieved. For example, the W/L of the transistor T1 to the W/L of the transistor T2 may be flexibly designed. A ratio of the W/L of the transistor T2 to the W/L of the transistor T3 may range between 12:1 and 30:1. A ratio of the W/L of the transistor T3 to the W/L of the transistor T5 may range between 0.5:1 and 3:1. A ratio of the W/L of the transistor T4 (T4') the W/L of the transistor T5 may range between 240:1 and 500:1. In this manner, a better solution to the color shift problem can be achieved.

In the prior art, a divided voltage is generated at the node N2 by adding a capacitor so as to control the voltage provided to the liquid crystal capacitor $C_{LCB}$. However, as discussed above, in the prior art, each pixel has to be electronically connected to at least two gate lines and function according to the corresponding gate driving signals on these two gate lines. In such a way, not only is the aperture ratio of the pixel circuit occupied, but also the number of channels of the gate driving signals increases, causing the timing control to become complicated.

As to the proposed pixel unit circuits, not only are the prior art problems solved as the aperture ratio of the pixel circuit is saved and the number of channels of the gate driving signals is reduced, but also a better solution to the color shift problem can be achieved. In addition, the timing control is relatively simple as compared to the prior art.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A liquid crystal display panel, comprising:

a plurality of pixel units, wherein each of the pixel units is connected to a data line and a gate line and defines a first region and a second region, the pixel unit comprising:

a first liquid crystal capacitor, disposed in the first region;

a first transistor, disposed in the first region and connected between the data line and the first liquid crystal capacitor, and comprising a control electrode connected to the gate line;

a second liquid crystal capacitor, disposed in the second region;

a second transistor, disposed in the second region and connected between the data line and the second liquid crystal capacitor, and comprising a control electrode connected to the gate line;

a third transistor, disposed in the second region and connected between a common voltage and the second transistor, and comprising a control electrode connected to the gate line; and a circuit subunit, disposed in the second region and coupled in parallel with the third transistor between the common voltage and the second transistor, wherein the circuit subunit comprises a fourth transistor comprising a control electrode connected to the gate line, wherein the circuit subunit further comprises:

a fifth transistor, comprising a control electrode coupled to the common voltage, wherein the fourth transistor is connected between the fifth transistor and the second transistor, wherein a ratio of a width to length ratio of the second transistor to a width to length ratio of the third transistor ranges between 12:1 and 30:1, a ratio of the width to length ratio of the third transistor to a width to length ratio of the fourth transistor ranges between 0.5:1 and 3:1, and a ratio of a width to length ratio of the fifth transistor to the width to length ratio of the fourth transistor ranges between 240:1 and 500:1.

2. The liquid crystal display panel as claimed in claim 1, wherein when the first transistor, the second transistor and the third transistor are turned on in response to a gate driving signal on the gate line, the circuit subunit and the third transistor coupled in parallel are equivalent to a variable resistor between the common voltage and the second transistor.

3. The liquid crystal display panel as claimed in claim 1, wherein the circuit subunit further comprises:

a diode, connected to the common voltage, wherein the fourth transistor is connected between the diode and the second transistor.

4. A pixel unit circuit, comprising:

a first liquid crystal capacitor;

a first transistor, connected between a data line and the first liquid crystal capacitor, and comprising a control electrode connected to a gate line;

a second liquid crystal capacitor;

a second transistor, connected between the data line and the second liquid crystal capacitor, and comprising a control electrode connected to the gate line;

a third transistor, connected between a common voltage and the second transistor, and comprising a control electrode connected to the gate line; and a circuit subunit, coupled in parallel with the third transistor between the common voltage and the second transistor, wherein the circuit subunit comprises a fourth transistor comprising a control electrode connected to the gate line, wherein the circuit subunit further comprises:

a fifth transistor, comprising a control electrode coupled to the common voltage, wherein the fourth transistor is connected between the fifth transistor and the second transistor, wherein a ratio of a width to length ratio of the second transistor to a width to length ratio of the third transistor ranges between 12:1 and 30:1, a ratio of the width to length ratio of the third transistor to a width to length ratio of the fourth transistor ranges between 0.5:1 and 3:1, and a ratio of a width to length ratio of the fifth transistor to the width to length ratio of the fourth transistor ranges between 240:1 and 500:1.

5. The pixel unit circuit as claimed in claim 4, wherein when the first transistor, the second transistor and the third transistor are turned on in response to a gate driving signal on the gate line, the circuit subunit and the third transistor coupled in parallel are equivalent to a variable resistor between the common voltage and the second transistor.

6. The pixel unit circuit as claimed in claim 4, wherein the circuit subunit further comprises:

a diode, connected to the common voltage, wherein the fourth transistor is connected between the diode and the second transistor.

* * * * *